US011206492B2

(12) United States Patent
Ge et al.

(10) Patent No.: US 11,206,492 B2
(45) Date of Patent: Dec. 21, 2021

(54) SCREEN SOUNDING EXCITER AND ELECTRONIC DEVICE

(71) Applicant: AAC Technologies Pte. Ltd., Singapore (SG)

(72) Inventors: Huan Ge, Shenzhen (CN); Lubin Mao, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/996,909

(22) Filed: Aug. 19, 2020

(65) Prior Publication Data

US 2021/0136499 A1 May 6, 2021

(30) Foreign Application Priority Data

Oct. 31, 2019 (CN) ..... 201911053320.2

(51) Int. Cl.
*H04R 9/06* (2006.01)
*H04R 9/10* (2006.01)

(52) U.S. Cl.
CPC ..... *H04R 9/10* (2013.01); *H04R 9/06* (2013.01)

(58) Field of Classification Search
CPC ..... H04R 9/06; H04R 2209/024; H04R 2400/07; H04R 2440/05; H04R 2499/15
See application file for complete search history.

(56) References Cited

U.S. PATENT DOCUMENTS

| | | | | |
|---|---|---|---|---|
| 7,369,674 | B2 * | 5/2008 | Miura | H04R 9/10 381/396 |
| 8,942,410 | B2 * | 1/2015 | Wilk | H04R 9/025 381/412 |
| 10,674,270 | B2 * | 6/2020 | Clissold-Bate | H04R 1/2811 |
| 2015/0181331 | A1 * | 6/2015 | Kim | H04R 1/00 381/162 |
| 2020/0145745 | A1 * | 5/2020 | Wakeland | H04R 1/2857 |
| 2021/0136500 | A1 * | 5/2021 | Ge | H04M 1/0266 |

* cited by examiner

*Primary Examiner* — Ryan Robinson
(74) *Attorney, Agent, or Firm* — W&G Law Group

(57) ABSTRACT

The present invention discloses a screen sounding exciter and an electronic device. The screen sounding exciter includes a first magnetic circuit system, an electromagnetic driving system, and a second magnetic circuit system which are sequentially arranged along a vibrating direction of the display screen from top to bottom, and an elastic member, the electromagnetic driving system includes a first electromagnet, a second electromagnet, and a magnetic conductive shell isolating a bottom of the first electromagnet from a top of the second electromagnet; a top of the first electromagnet is spaced apart from a bottom of the first magnetic circuit system to form a first vibrating gap; a bottom of the second electromagnet is spaced apart from a top of the second magnetic circuit system to form a second vibrating gap.

18 Claims, 7 Drawing Sheets

SCREEN SOUNDING EXCITER AND ELECTRONIC DEVICE

FIELD OF THE PRESENT INVENTION

The invention relates to a field of acoustic technology, and more particularly to a screen sounding exciter and an electronic device.

DESCRIPTION OF RELATED ART

At present, there are mainly two types of screen sounding exciters in mobile phones. One type is a piezoceramic unit exciter, a multi-layer piezoceramic sheets are attached to a metal foil, which is called a vibrating diaphragm. When the diaphragm is supplied with an alternating voltage, the diaphragm will continuously bend up and down as the voltage changes, so as to drive the load structure to vibrate and sound. The other type is a micro-vibrating unit exciter, which can generate a force field by using the interaction of the electric field and the magnetic field.

SUMMARY OF THE PRESENT INVENTION

The purpose of the present invention is to provide a screen sounding exciter and an electronic device which can enhance or weaken the vibrating effect of the back cover.

In one aspect of the present invention, a screen sounding exciter is provided and is applied to an electronic device. The electronic device includes a display screen driven by the screen sounding exciter to generate sound, and a back cover forming a receiving space together with the display screen. The screen sounding exciter includes a first magnetic circuit system, an electromagnetic driving system, and a second magnetic circuit system which are sequentially arranged along a vibrating direction of the display screen from top to bottom. The first magnetic circuit system is fixed on the display screen, and the electromagnetic driving system is fixed on the back cover. The screen sounding exciter further includes an elastic member, one end of the elastic member is connected to the second magnetic circuit system to elastically support the second magnetic circuit system and the other end of the elastic member is fixed on the electromagnetic driving system. The electromagnetic driving system includes a first electromagnet, a second electromagnet and a magnetic conductive shell isolating a bottom of the first electromagnet from a top of the second electromagnet; a top of the first electromagnet and a bottom of the first magnetic circuit system are spaced apart from each other to form a first vibrating gap, a bottom of the second electromagnet and a top of the second circuit system are spaced apart from each other to form a second vibrating gap magnetic conductive shell.

Furthermore, the first electromagnet includes a first voice coil and a first iron core inserted into a hollow position of the first voice coil. The second electromagnet includes a second voice coil and a second iron core inserted in a hollow position of the second voice coil.

Furthermore, the electromagnetic driving system includes a first supporting frame fixed on the back cover and a second supporting frame arranged between the first supporting frame and the magnetic conductive shell.

Furthermore, the first magnetic circuit system includes a screen connecting plate and a first magnet, one side of the screen connecting plate is fixed on the display screen, and the first magnet is fixed on the other side of the screen connecting plate.

Furthermore, the second magnetic circuit system includes a mass block connected to the second supporting frame through the elastic member and a second magnet fixed in a hollow position of the mass block.

Furthermore, the elastic member includes a first connecting portion sandwiched between the first supporting frame and the second supporting frame, a second connecting portion fixedly connected to the mass block, and a spring, one end of the spring is connected to the first connecting portion and the other end of the spring is connected to the second connecting portion.

Furthermore, the first connecting portion is a first ring-shaped connecting piece matched with an outer edge of the first supporting frame and an outer edge of the second supporting frame. The second connecting portion is a second ring-shaped connecting piece matched with an outer edge of the mass block. The second ring-shaped connecting piece is fixed in a hollow groove of the first ring-shaped connecting piece through the spring.

Furthermore, both the first magnet and the second magnet are permanent magnets. A direction of a force applied by the first magnet to the first electromagnet is opposite to a direction of a force applied by the second magnet to the second electromagnet.

Furthermore, both the first magnet and the second magnet are permanent magnets. A direction of a force applied by the first magnet to the first electromagnet is the same as a direction of a force applied by the second magnet to the second electromagnet.

In another aspect of the present disclosure, an electronic device includes a display screen, a middle frame fixing the display screen, a back cover fixedly connected to the middle frame, and a battery accommodated in the middle frame. The electronic device further includes at least one screen sounding exciter arranged on the back cover and connected to the display screen. The screen sounding exciter includes a first magnetic circuit system, an electromagnetic driving system, and a second magnetic circuit system which are sequentially arranged along a vibrating direction of the display screen from top to bottom. The first magnetic circuit system is fixed on the display screen, and the electromagnetic driving system is fixed on the back cover. The screen sounding exciter further includes an elastic member, one end of the elastic member is connected to the second magnetic circuit system to elastically support the second magnetic circuit system and the other end of the elastic member is fixed on the electromagnetic driving system. The electromagnetic driving system includes a first electromagnet, a second electromagnet and a magnetic conductive shell isolating a bottom of the first electromagnet from a top of the second electromagnet; a top of the first electromagnet and a bottom of the first magnetic circuit system are spaced apart from each other to form a first vibrating gap; a bottom of the second electromagnet and a top of the second circuit system are spaced apart from each other to form a second vibrating gap magnetic conductive shell.

The advantages of the present invention are detailed as following: the magnetic circuit system of the present disclosure is divided into a first magnetic circuit system and a second magnetic circuit system. The first vibrating gap is formed between the first electromagnet and the first magnetic circuit system, and the second vibrating gap is formed between the second electromagnet and the second magnetic circuit system. Under the influence of the electromagnetic fields of the first electromagnet and the second electromagnet, the first magnetic circuit system drives the display screen to generate sound. The second magnetic circuit system is connected with the electromagnetic driving system through the elastic member, and can apply a force to the electromagnetic driving system together with the first magnetic circuit system at the same time. By setting the polarity direction of the first magnetic circuit system, the second magnetic circuit system, the first electromagnet and the second electromagnet, the force applied by the first magnetic circuit system and the second magnetic circuit system can be counteracted or strengthened, thereby reducing the possibility of the vibration of the back cover fixedly connected to the electromagnetic driving system, or enhancing the vibration to generate sound together with the screen, thus to improve the users' experience.

DETAILED DESCRIPTION OF THE EXEMPLARY EMBODIMENT

The present invention will be further described below with reference to the drawings and embodiments.

Figure 1:
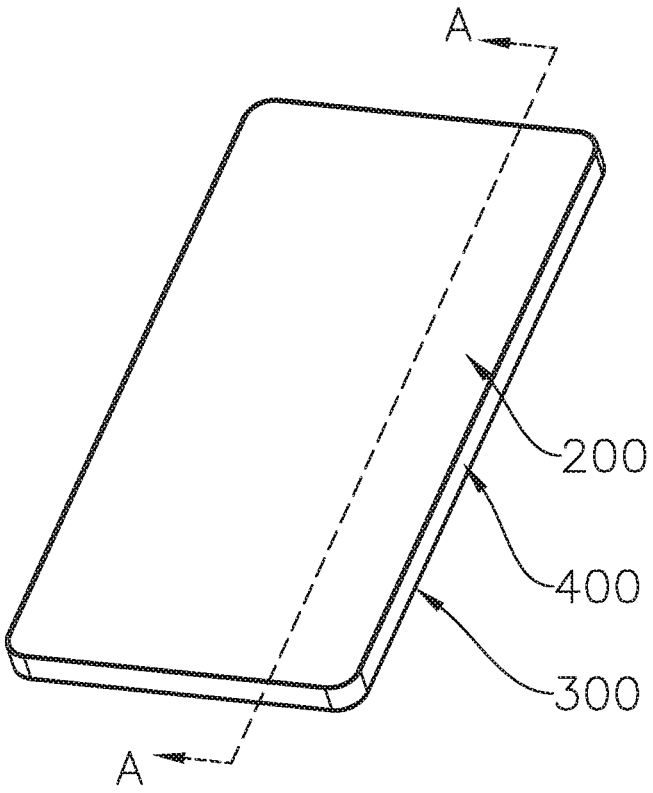
FIG. 1 is a perspective structural view of an electronic device according to an embodiment of the present invention.
Figure 2:
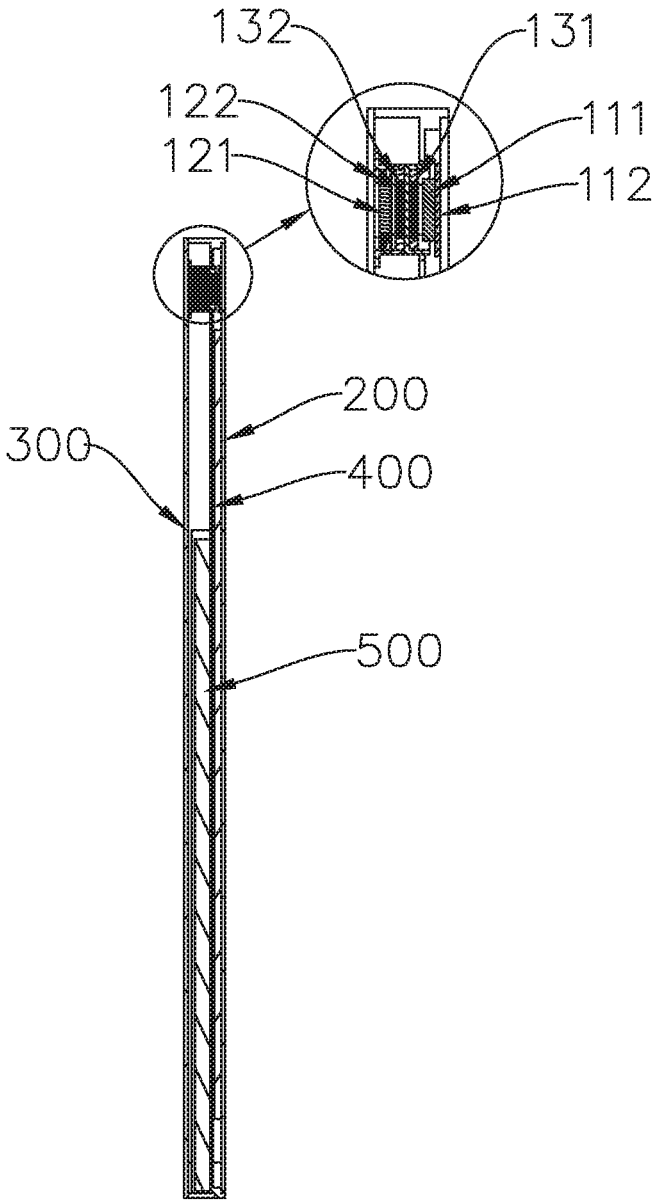
FIG. 2 is a cross-sectional view of the electronic device taken along line A-A in FIG. 1 according to the embodiment of the present invention.
Figure 3:
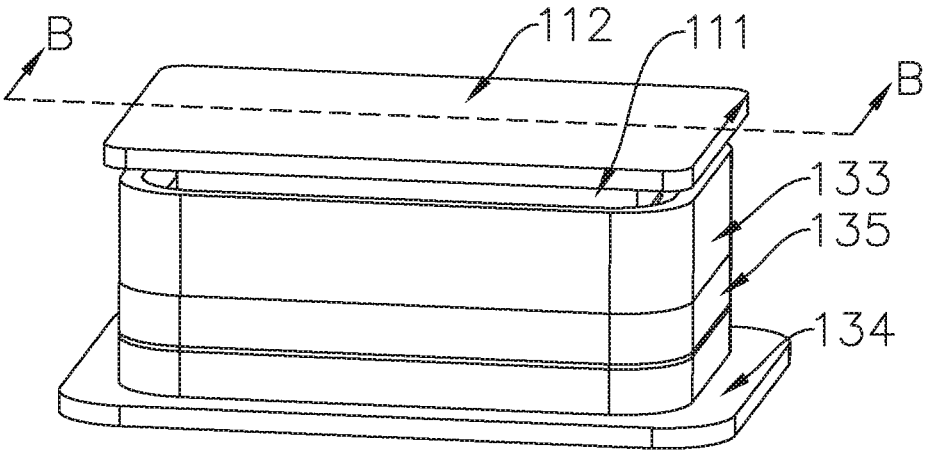
FIG. 3 is a structural view of a screen sounding exciter according to the embodiment of the present invention.
Figure 4:
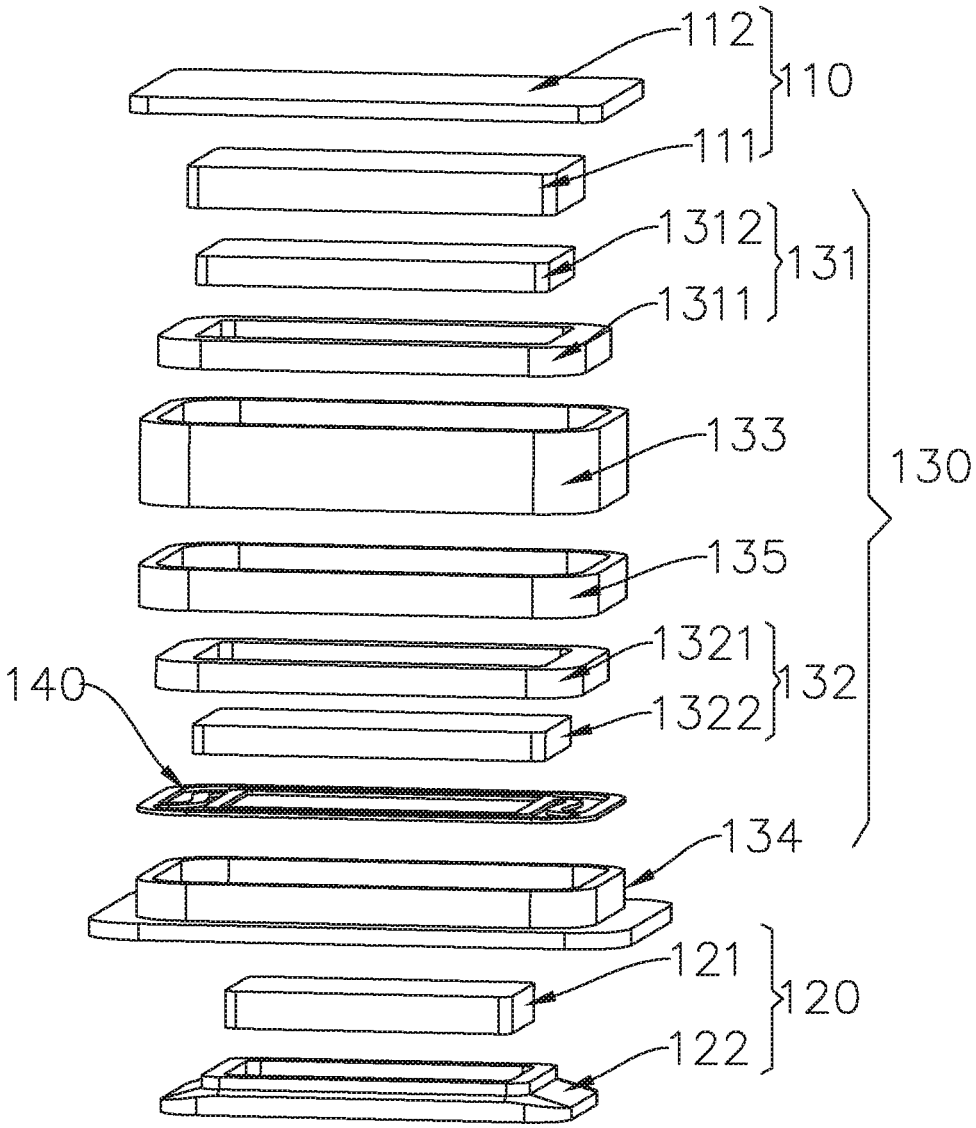
FIG. 4 is a perspective exploded view of the screen sounding exciter according to the embodiment of the present invention.
Figure 5:
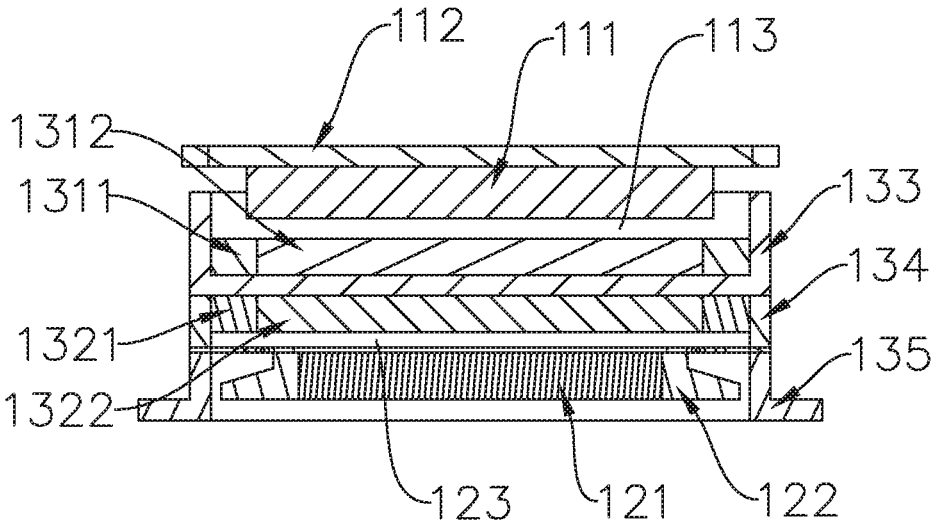
FIG. 5 is a cross-sectional view of the screen sounding exciter taken along line B-B in FIG. 3 according to the embodiment of the present invention.

Please refer to FIG. 1 through FIG. 2, the present invention discloses an electronic device, including a display screen 200, a middle frame 400 fixing the display screen 200, a back cover 300 fixedly connected to the middle frame 400, a battery 500 accommodated in the middle frame 400, and at least one screen sounding exciter 100 provided on the back cover 300 and fixedly connected with the display screen 200. There is no direct connection between the middle frame 400 and the screen sounding exciter 100. The middle frame 400 is provided with a plurality of through holes for the screen sounding exciter 100 passing through thereof to fix on the back cover 300.

Please further refer to FIG. 1 through FIG. 5, the screen sounding exciter 100 includes a first magnetic circuit system 110, an electromagnetic driving system 130, and a second magnetic circuit system 120 which are sequentially arranged along a vibrating direction of the display screen 200 from top to bottom. The first magnetic circuit system 110 is fixed to the display screen 200, and the electromagnetic driving system 130 is fixed to the back cover 300. The screen sounding exciter 100 further includes an elastic member 140. One end of the elastic member 140 is connected to the second magnetic circuit system 120 to elastically support the second magnetic circuit system 120 and the other end of the elastic member 140 is fixed to the electromagnetic driving system 130. The electromagnetic driving system 130 includes a first electromagnet 131, a second electromagnet 132 and a magnetic conductive shell 133 isolating the bottom of the first electromagnet 131 and the top of the second electromagnet 132. A top of the first electromagnet 131 is spaced apart from a bottom of the first magnetic circuit system whose top is formed a first vibrating gap 113 with a bottom of the first magnetic circuit system 110, whose top is formed a second vibrating gap 123 with a bottom of the second magnetic circuit system 120, and a magnetic conductive shell 133 isolating the bottom of the first electromagnet 131 and the top of the second electromagnet 132.

Compared to the related art, in the present invention, the magnetic circuit system is divided into the first magnetic circuit system 110 and the second magnetic circuit system 120. The first vibrating gap 113 is formed between the first electromagnet 131 and the first magnetic circuit system 110, and the second vibrating gap 123 is formed between the second electromagnet 132 and the second magnetic circuit system 120. Under the influence of the electromagnetic fields of the first electromagnet 131 and the second electromagnet 132, the first magnetic circuit system 110 drives the display screen 200 to generate sound. The second magnetic circuit system 120 is connected to the electromagnetic driving system 130 through the elastic member 140 and can apply a force to the electromagnetic driving system 130 together with the first magnetic circuit system 110 at the same time. By setting the polarity direction of the first magnetic circuit system 110, the second magnetic circuit system 120, the first electromagnet 131 and the second electromagnet 132, the forces applied by the first magnetic circuit system 110 and the second magnetic circuit system 120 can be counteracted or strengthened, thereby reducing the possibility of the vibration of the back cover 300 fixedly connected to the electromagnetic driving system 130, or enhancing the vibration to generate sound together with the screen, thus to improve the users' experience.

In the present embodiment, the first electromagnet 131 includes a first voice coil 1311 and a first iron core 1312 inserted into a hollow position of the first voice coil 1311. The second electromagnet 132 includes a second voice coil 1321 and a second iron core 1322 inserted into a hollow position of the second voice coil 1321. The first voice coil 1311 and the second voice coil 1321 are both electrically connected to the control main board in the electronic device. The electromagnetic field centered on the iron core is formed after a current is flowed into the voice coil. The first magnet 111 and the second magnet 121 generate vibration effects respectively because of the electromagnetic field. The first magnet 111 vibrates to drive the screen of the display screen 200 to generate sound, and the second magnet 121 is connected to the electromagnetic driving system 130 through the elastic member 140 only, so the vibration of the middle frame 400 or the back cover 300 will not be affected.

In the present embodiment, the electromagnetic driving system 130 includes a first supporting frame 133 fixed on the back cover 300 and a second supporting frame 135 arranged between the first supporting frame 134 and a magnetic conductive shell 133. One end of the first supporting frame 134 is fixedly connected to the magnetic conductive shell 133, and the other end of the first supporting frame 134 is fixedly connected to the second supporting frame 135. The magnetic conductive shell 133 is used to fix the first electromagnet 131 and to isolate the first electromagnet 131 from the second electromagnet 132. The first supporting frame 134 is used to fix the second electromagnet 132, and the second supporting frame 135 is used for fixing on the back cover 300. Therefore, the first supporting frame 134, the second supporting frame 135, the magnetic conductive shell 133, the first electromagnet 131, and the second electromagnet 132 are all fixed to the back cover 300. If the back cover 300 vibrates, the whole structure vibrates; and if the vibration is counteracted, the whole structure will not vibrate.

In the present embodiment, the first magnetic circuit system 110 includes a screen connecting plate 112 and a first magnet 111, one side is fixed on the display screen 200 and the first magnet 111 is fixed on the other side of the screen connecting plate 112. One side of the screen connecting plate 112 is in contact with an inner surface of the display screen 200, and the other side of the screen connecting plate 112 is fixed to the first magnet 111. When the first magnet 111 is affected by the electromagnetic field generated by the electromagnetic driving system 130, the display screen 200 is driven to vibrate and sound in the first vibrating gap 113.

In the present embodiment, the second magnetic circuit system 120 includes a mass block 122 connected to the second supporting frame 135 through the elastic member 140 and a second magnet 121 fixed in a hollow position of the mass block 122. The mass block 122 is used to fix the second magnet 121, and has a certain weight to provide a certain reactive force to the electromagnetic driving system 130.

Figure 6:
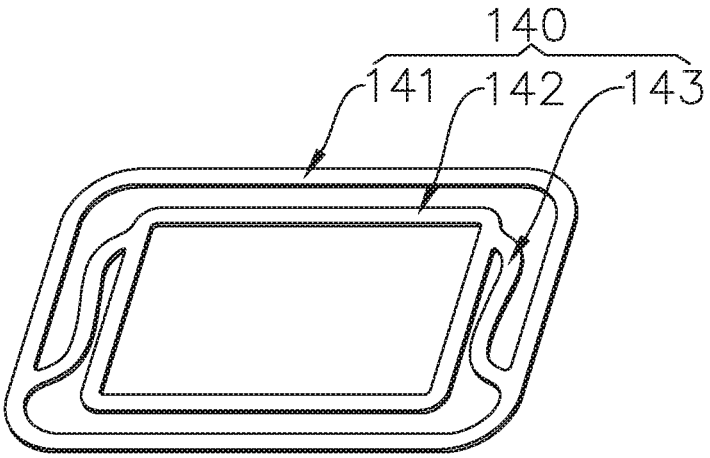
FIG. 6 is a structural view of an elastic member according to the embodiment of the present invention.

Please further refer to FIG. 6, the elastic member 140 includes a first connecting portion 141 sandwiched between the first supporting frame 134 and the second supporting frame 135, a second connecting portion 142 fixedly connected to the mass block 122, and a spring 143, one end of the spring 143 is connected to the first connecting portion 141 and the other end of the spring 143 is connected to the second the connecting portion 142.

In the present embodiment, the first connecting portion 141 is a first ring-shaped connecting piece matched with an outer edge of the first supporting frame 134 and an outer edge of the second supporting frame body 135. Both sides of the first ring-shaped connecting piece are seamlessly bonded with the edge of the first supporting frame 134 and the edge of the second support frame 135 by glue. The second connecting portion 142 is a second ring-shaped connecting piece matched with an outer edge of the mass block 122. One side of the second ring-shaped connecting piece is seamlessly bonded with the edge of the mass block 122 by glue. The second ring-shaped connecting piece is fixed in a hollow groove of the first ring-shaped connecting piece through the springs 143.

Specially, an outer diameter of the first ring-shaped connecting piece is larger than that of the second ring-shaped connecting piece. Under the influence of the electromagnetic field, the spring 143 is bent, so that the first ring-shaped connecting piece and the second ring-shaped connecting piece vibrate at different height positions. The spring 143 has a straight or curved elastic sheet structure with ductility. The number of the springs 143 is determined according to the specific shapes of the first ring-shaped connecting piece and the second ring-shaped connecting piece.

Figure 7:
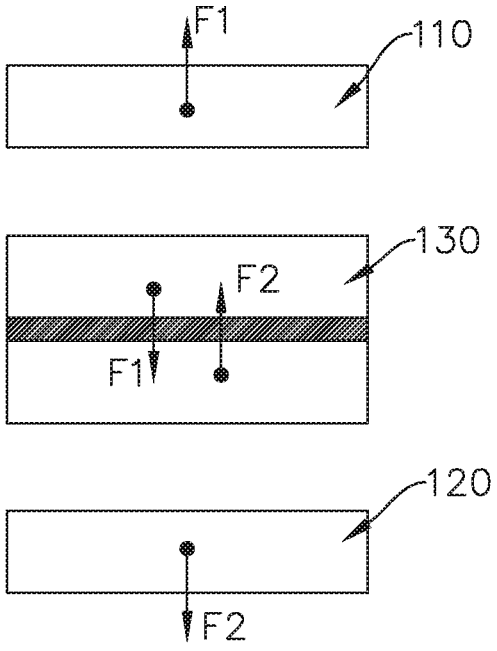
FIG. 7 is a schematic view of a first force relationship of the screen sounding exciter according to the embodiment of the present invention.
Figure 8:
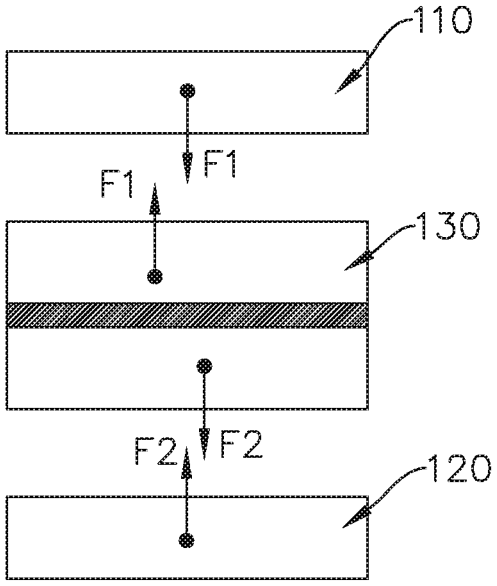
FIG. 8 is a schematic view of a second force relationship of the screen sounding exciter according to the embodiment of the present invention.

Please further refer to FIG. 7 to FIG. 8, the first magnet 111 and the second magnet 121 are both permanent magnets. A direction of the force applied by the first magnet 111 to the first electromagnet 131 is opposite to a direction of the force applied by the second magnet 121 to the second electromagnet 132. When the first electromagnet 131 and the second electromagnet 132 are respectively supplied with the electrical signals to operate, an interaction force is formed between the first electromagnet 131 and the first magnet 111, and the interaction force has the same magnitude, which is marked as F1. An interaction force is formed between the second electromagnet 132 and the second magnet 121, and the interaction force has the same magnitude, which is marked as F2. When the direction of F1 applied by the first magnet 111 is opposite to the direction of F2 applied by the second magnet 121, as shown in a schematic view of a first force relationship in FIG. 7, a mutual repulsive force is formed between the first magnet 111 and the first electromagnet 131, and a mutual repulsive force is formed between the second magnet 121 and the second electromagnet 132. As shown in a schematic view of a second force relationship in FIG. 8, a mutual attraction force is formed between the first magnet 111 and the first electromagnet 131, and a mutual attraction force is formed between the second magnet 121 and the second electromagnet 132. When force F1 is equal to force F2, the external forces received by the electromagnetic driving system 130 are canceled by each other, thus to ensure that the back cover 300 will not generate vibration. When force F1 is not equal to force F2, the external forces can also be counteracted a part, and the vibration of the back cover 300 will be weak correspondingly. The relationship between F1 and F2 can be adjusted by a magnetic circuit structure of the first magnet 111, a magnetic circuit structure of the second magnet 121 and a design of the driving electrical signal, thus to improve the users' experience.

Figure 9:
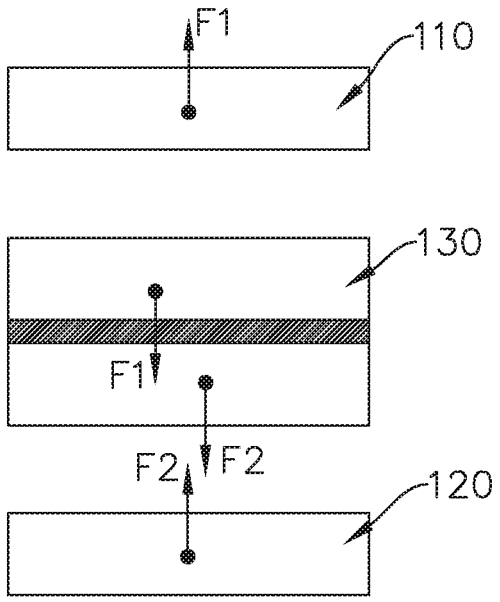
FIG. 9 is a schematic view of a third force relationship of the screen sounding exciter according to the embodiment of the present invention.
Figure 10:
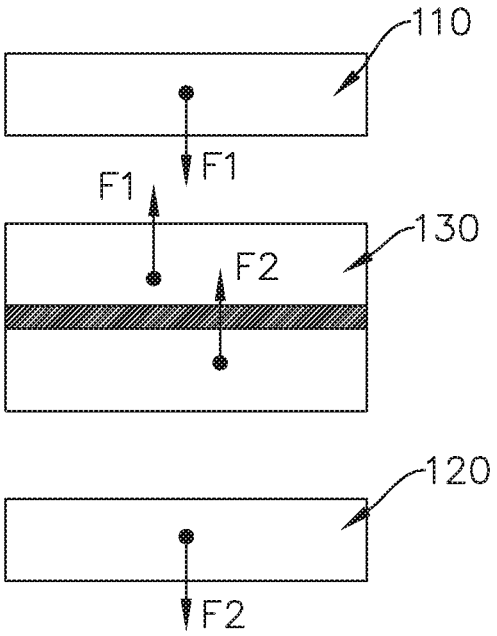
FIG. 10 is a schematic view of a fourth force relationship of the screen sounding exciter according to the embodiment of the present invention.

Please further refer to FIG. 9 to FIG. 10, the first magnet 111 and the second magnet 121 are both permanent magnets. A direction of the force applied by the first magnet 111 to the first electromagnet 131 is the same as a direction of the force applied by the second magnet 121 to the second electromagnet 132. When the first electromagnet 131 and the second electromagnet 132 are respectively supplied with the electrical signal to operate, an interaction force is formed between the first electromagnet 131 and the first magnet 111. The interaction force has the same magnitude, which is marked as F1. An interaction force is formed between the second electromagnet 132 and the second magnet 121. The interaction force has the same magnitude, which is marked as F2. When the direction of F1 applied by the first magnet 111 is the same as the direction of F2 applied by the second magnet 121, as shown in a schematic view of a third force relationship in FIG. 9, a mutual repulsive force is formed between the first magnet 111 and the first electromagnet 131, and an attractive force is formed between the second magnet 121 and the second electromagnet 132. As shown in a schematic view of a fourth force relationship in FIG. 10, an attractive force is formed between the first magnet 111 and the first electromagnet 131, and a mutual repulsive force is formed between the second magnet 121 and the second electromagnet 132. At this time, the F1 and F2 received by the electromagnetic driving system 130 are in the same direction, and the two forces are added together, so that the electromagnetic driving system 130 drives the back cover 300 to vibrate and sound together with the screen simultaneously, thereby improving the sound effect of the whole device.

In summary, with different designs of the internal magnets of the device, the driving electrical signal of the first electromagnet and the driving electrical signal of the second electromagnet, the present invention can achieved two different effects during the working process of the screen-sounding mobile phone. One is to counteract the vibration of the back cover to improve the users' griping experience, and the other is to increase the vibration of the back cover to drive it to generate sound together with the screen at the same time, thus to improve the sound effect.

The above description is only preferred embodiment of the present invention, and it should be noted that those skilled in the art can also make improvements without departing from the inventive concept of the present invention, but these improvements all belong to the protection scope of the invention.

What is claimed is:

1. A screen sounding exciter applied to an electronic device, the electronic device comprising a display screen driven by the exciter to generate sound, and a back cover forming a receiving space with the display screen; wherein, the screen sounding exciter comprises a first magnetic circuit system, an electromagnetic driving system, and a second magnetic circuit system which are sequentially arranged along a vibrating direction of the display screen from top to bottom, the first magnetic circuit system is fixed on the display screen, and the electromagnetic driving system is fixed on the back cover;

the screen sounding exciter further comprises an elastic member, one end of the elastic member is connected to the second magnetic circuit system to elastically support the second magnetic circuit system and the other end of the elastic member is fixed to the electromagnetic driving system;

the electromagnetic driving system comprises a first electromagnet, a second electromagnet, and a magnetic conductive shell isolating a bottom of the first electromagnet from a top of the second electromagnet; a top of the first electromagnet is spaced apart from a bottom of the first magnetic circuit system to form a first vibrating gap; a bottom of the second electromagnet is spaced apart from a top of the second magnetic circuit system to form a second vibrating gap.

2. The screen sounding exciter according to claim 1, wherein the first electromagnet comprises a first voice coil and a first iron core inserted into a hollow position of the first voice coil; the second electromagnet comprises a second voice coil and a second iron core inserted into a hollow position of the second voice coil.

3. The screen sounding exciter according to claim 2, wherein the electromagnetic driving system further comprises a first supporting frame fixed to the back cover and a second supporting frame arranged between the first supporting frame and the magnetic conductive shell.

4. The screen sounding exciter according to claim 3, wherein the first magnetic circuit system comprises a screen connecting plate and a first magnet, one side of the screen connecting plate is fixed on the display screen, and the first magnet fixed on the other side of the screen connecting plate.

5. The screen sounding exciter according to claim 4, wherein the second magnetic circuit system comprises a mass block connected to the second supporting frame through the elastic member, and a second magnet fixed in a hollow position of the mass block.

6. The screen sounding exciter according to claim 5, wherein the elastic member comprises a first connecting portion sandwiched between the first supporting frame and the second supporting frame, a second connecting portion fixedly connected to the mass block, and a spring; one end of the spring is connected to the first connecting portion and the other end of the spring is connected to the second connecting portion.

7. The screen sounding exciter according to claim 6, wherein the first connecting portion is a first ring-shaped connecting piece matched with an outer edge of the first supporting frame and an outer edge of the second supporting frame; and the second connecting portion is a second ring-shaped connecting piece matched with an outer edge of the mass block; the second ring-shaped connecting piece is fixed in a hollow groove of the first ring-shaped connecting piece through the spring.

8. The screen sounding exciter according to claim 5, wherein both the first magnet and the second magnet are permanent magnets, and a direction of a force applied by the first magnet to the first electromagnet is opposite to a direction of a force applied by the second magnet to the second electromagnet.

9. The screen sounding exciter according to claim 5, wherein both the first magnet and the second magnet are permanent magnets, and a direction of a force applied by the first magnet to the first electromagnet is the same as a direction of a force applied by the second magnet to the second electromagnet.

10. An electronic device, comprising a display screen, a middle frame fixing the display screen, a back cover fixedly connected to the middle frame, and a battery accommodated in the middle frame, wherein the electronic device further comprises at least one screen sounding exciter arranged on the back cover and connected to the display screen; wherein, the screen sounding exciter comprises a first magnetic circuit system, an electromagnetic driving system, and a second magnetic circuit system which are sequentially arranged along a vibrating direction of the display screen from top to bottom, the first magnetic circuit system is fixed on the display screen, and the electromagnetic driving system is fixed on the back cover;

the screen sounding exciter further comprises an elastic member, one end of the elastic member is connected to the second magnetic circuit system to elastically support the second magnetic circuit system and the other end of the elastic member is fixed to the electromagnetic driving system;

the electromagnetic driving system comprises a first electromagnet, a second electromagnet, and a magnetic conductive shell isolating a bottom of the first electromagnet from a top of the second electromagnet; a top of the first electromagnet is spaced apart from a bottom of the first magnetic circuit system to form a first vibrating gap; a bottom of the second electromagnet is spaced apart from a top of the second magnetic circuit system to form a second vibrating gap.

11. The electronic device according to claim 10, wherein the first electromagnet comprises a first voice coil and a first iron core inserted into a hollow position of the first voice coil; the second electromagnet comprises a second voice coil and a second iron core inserted into a hollow position of the second voice coil.

12. The electronic device according to claim 11, wherein the electromagnetic driving system further comprises a first supporting frame fixed to the back cover and a second supporting frame arranged between the first supporting frame and the magnetic conductive shell.

13. The electronic device according to claim 12, wherein the first magnetic circuit system comprises a screen connecting plate and a first magnet, one side of the screen connecting plate is fixed on the display screen, and the first magnet fixed on the other side of the screen connecting plate.

14. The electronic device according to claim 13, wherein the second magnetic circuit system comprises a mass block connected to the second supporting frame through the elastic member, and a second magnet fixed in a hollow position of the mass block.

15. The electronic device according to claim 14, wherein the elastic member comprises a first connecting portion sandwiched between the first supporting frame and the second supporting frame, a second connecting portion fixedly connected to the mass block, and a spring; one end of the spring is connected to the first connecting portion and the other end of the spring is connected to the second connecting portion.

16. The electronic device according to claim 15, wherein the first connecting portion is a first ring-shaped connecting piece matched with an outer edge of the first supporting frame and an outer edge of the second supporting frame; and the second connecting portion is a second ring-shaped connecting piece matched with an outer edge of the mass block; the second ring-shaped connecting piece is fixed in a hollow groove of the first ring-shaped connecting piece through the spring.

17. The electronic device according to claim 14, wherein both the first magnet and the second magnet are permanent magnets, and a direction of a force applied by the first magnet to the first electromagnet is opposite to a direction of a force applied by the second magnet to the second electromagnet.

18. The electronic device according to claim 14, wherein both the first magnet and the second magnet are permanent magnets, and a direction of a force applied by the first magnet to the first electromagnet is the same as a direction of a force applied by the second magnet to the second electromagnet.

* * * * *